United States Patent [19]

Guido

[11] Patent Number: 4,843,614

[45] Date of Patent: Jun. 27, 1989

[54] METALLURGICAL VESSEL

[75] Inventor: Heinz Guido, Duisberg, Fed. Rep. of Germany

[73] Assignee: Man Gutehoffnungshuette GmbH, Fed. Rep. of Germany

[21] Appl. No.: 146,325

[22] Filed: Jan. 21, 1988

[30] Foreign Application Priority Data

Jan. 22, 1986 [DE] Fed. Rep. of Germany ..... 3701678

[51] Int. Cl.[4] ..... H05B 7/11

[52] U.S. Cl. ..... 373/72; 373/108

[58] Field of Search ..... 373/72, 101, 103, 108

[56] References Cited

U.S. PATENT DOCUMENTS 3,578,893 5/1971 Kleinhagauer et al. ..... 373/101

4,566,108 1/1986 Bühler ..... 373/108

*Primary Examiner*—Roy N. Envall, Jr.

*Attorney, Agent, or Firm*—McGlew & Tuttle

[57] ABSTRACT

An electrical metallurgical furnace including a vessel and a bottom electrode positioned in the bottom of the vessel. At least one counter contact is provided connected to the bottom electrode. A support is anchored to the vessel connected to the insulation mounting unit. A tension frame is held by the insulation mounting unit. At least one current cable is provided for engagement with a side of the counter contact. A pivot element is provided for supporting the current cable. A biasing apparatus is provided for urging the pivotally supported current cable into contact with the counter contact.

7 Claims, 3 Drawing Sheets

METALLURGICAL VESSEL

BACKGROUND OF THE INVENTION

Field of the Invention

This invention relates in general to metallurgical furnaces and in particular to a new and useful electric metallurgical furnace having a bottom with a central counter-contact which is engaged by strap elements of current cables on respective opposite sides through bolts which are limited to the straps and biased against them.

Electric furnaces, in particular d-c arc furnaces, have a contact system in their bottom which establishes, during the melting process, the necessary electrical contact with the scrap or with the melt.

Such a contact system is described e.g. in EP-PS No. 0058817.

These bottom electrodes are subject to wear sooner than the hearth lining. As it is relatively labor-intensive to replace individual contact rods, it has become common practice to replace all contact rods jointly at appropriate intervals of time.

This changing is done preferably by removing the bottom electrode from the furnace vessel in one piece and replacing it with a new one. In this operation the current cables remain suspended from the furnace vessel bottom.

SUMMARY OF THE INVENTION

The invention provides a suspension for the current cables which simultaneously also established the reliable contact to the bottom electrode required for current conduction, in a simple manner, and which adapts itself to possbile displacements and inaccuracies of alignment of the counter-contact at the bottom electrode.

According to the invention, the current cables are secured to movable straps which are biased into engagement with a furnace counter-contact. The new design of the suspension device is outstanding for the fact that even after replacement of the bottom electrode the contact systems are reusable.

Accordingly, it is an object of the invention to provide an approved current contact connection through a counter-contact of a metallurgical furnace which includes current carrying cables which has strap portions which are biased against respective opposite sides of a counter-contact of the furnace by pivot bolts which are supported on the furnace by a tensioning frame.

A further object of the invention is to provide a metallurgical furnace which is simple in design, rugged in construction and economical to manufacture.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which preferred embodiments of the invention is illustrated.

BRIEF DESCRIPTION OF THE DRAWINGS In the drawings.

GENERAL DESCRIPTION OF THE PREFERRED EMBODIMENTS

Figure 1:
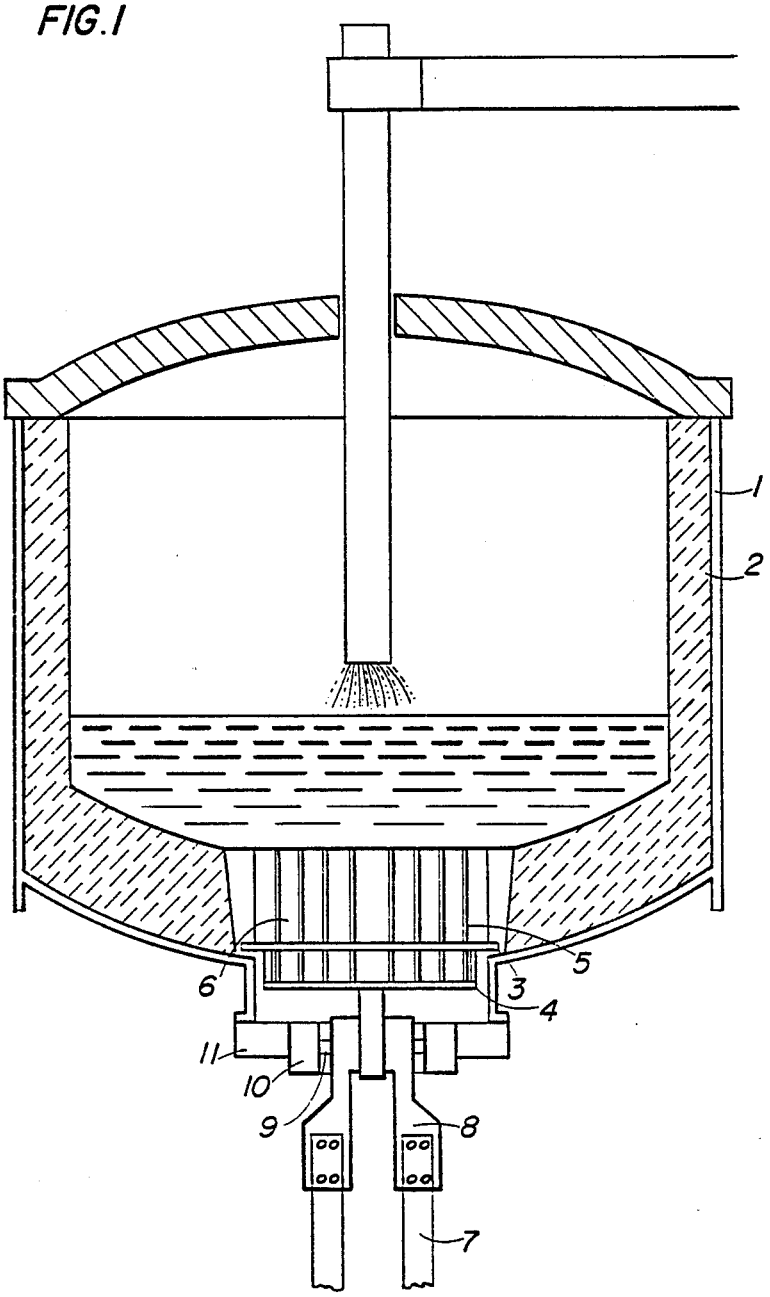
FIG. 1, is a section through an electric furnace vessel having current cable connections in accordance with the invention.

Referring to the drawings in particular the invention embodied therein comprises a current connection for a furnace vessel 1 having a refractory lining 2 and a bottom which includes contact rods 5 connected to a support plate 3 which in turn is connected to a base plate 4 and has a central counter-contact 14. In accordance with the invention current carrying cable 7, 7 has ends with straps 8 which have interior strap faces which abut against respective exterior sides of the counter-contact 14. The invention includes tensioning frame 10 including support 11 which carries bolt members 9 which are universally pivotally connected at 12 to exterior faces of the straps 8 and hold the straps against the counter-contact 14 by biasing means in the form of a spring 13.

FIG. 1 shows a furnace vessel 1 with a refractory lining 2 in its interior. In the center of the furnace vessel bottom can be seen the bottom electrode, comprising a support plate 3, base plate 4, contact rods 5 and refractory tamping 6. The current cables 7 are attached to the straps 8. By means of carrying bolts 9 the straps are suspended in a tensioning frame 10.

The tensioning frame 10 is fastened under insulation to two supports 11, which in turn are anchored on the furnace vessel.

Figure 2:
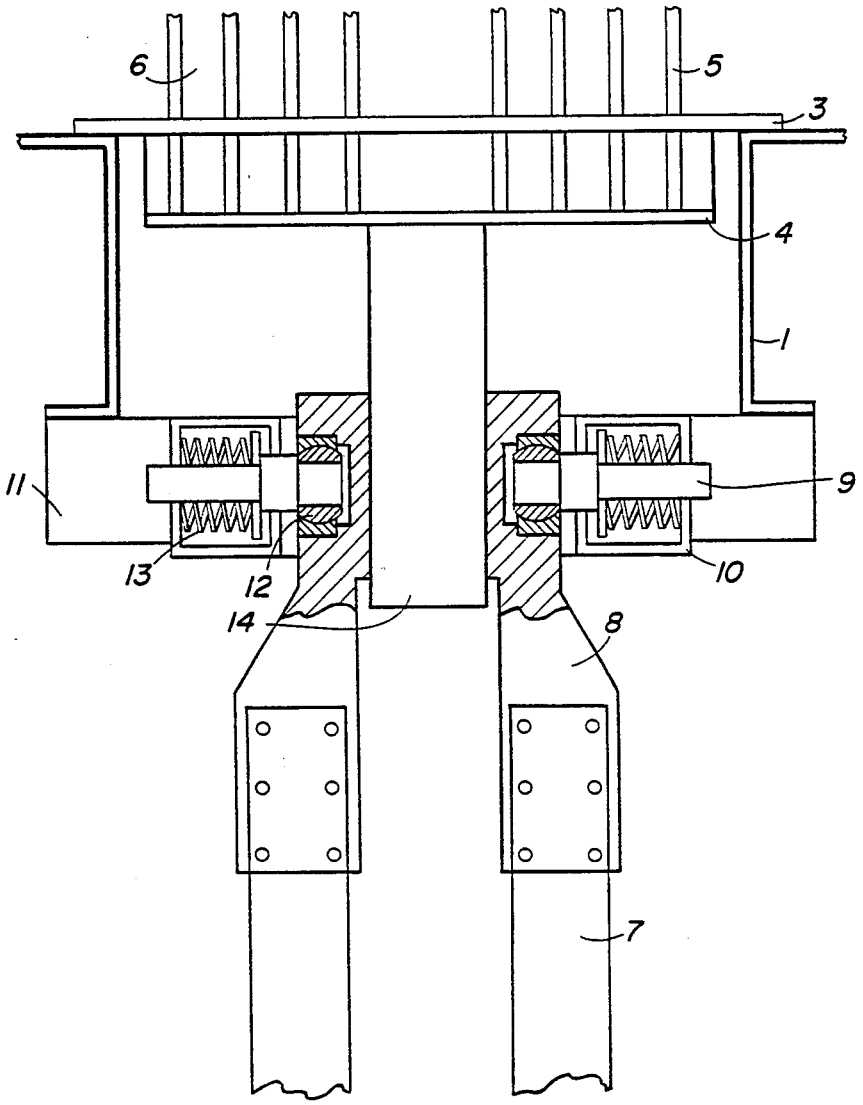
FIG. 2, is a section on a larger scale through the cable suspension and the insulated attachment.

FIG. 2 shows the details of the described arrangement. The union between the carrying bolts 9 and the strap 8 is angularly movable; it may be e.g. an articulated bearing. Due to the angular mobility the strap is able to place itself without forcing exactly against the counter-contact 14 of the bottom electrode;. A spring 13 installed in the tensioning frame 10 pushes, by means of a displaceable carrying bolt 9 and articulated bearing 12, the strap 8 against the counter-contact 14. Opening of the contact system as required for changing the bottom electrode is done by retracting the carrying bolts 9 from outside the tensioning frame. Thereby also the straps 8 are pulled back and the contact is opened.

In the practical realization of the invention numerous variations are conceivable. Thus, applying of the straps can be brought about by hydraulic or pneumatic elements rather than by springs. The pulling back of the carrying bolts can be done by forcing screws, wedges or hydraulic or pneumatic elements.

Figure 3:
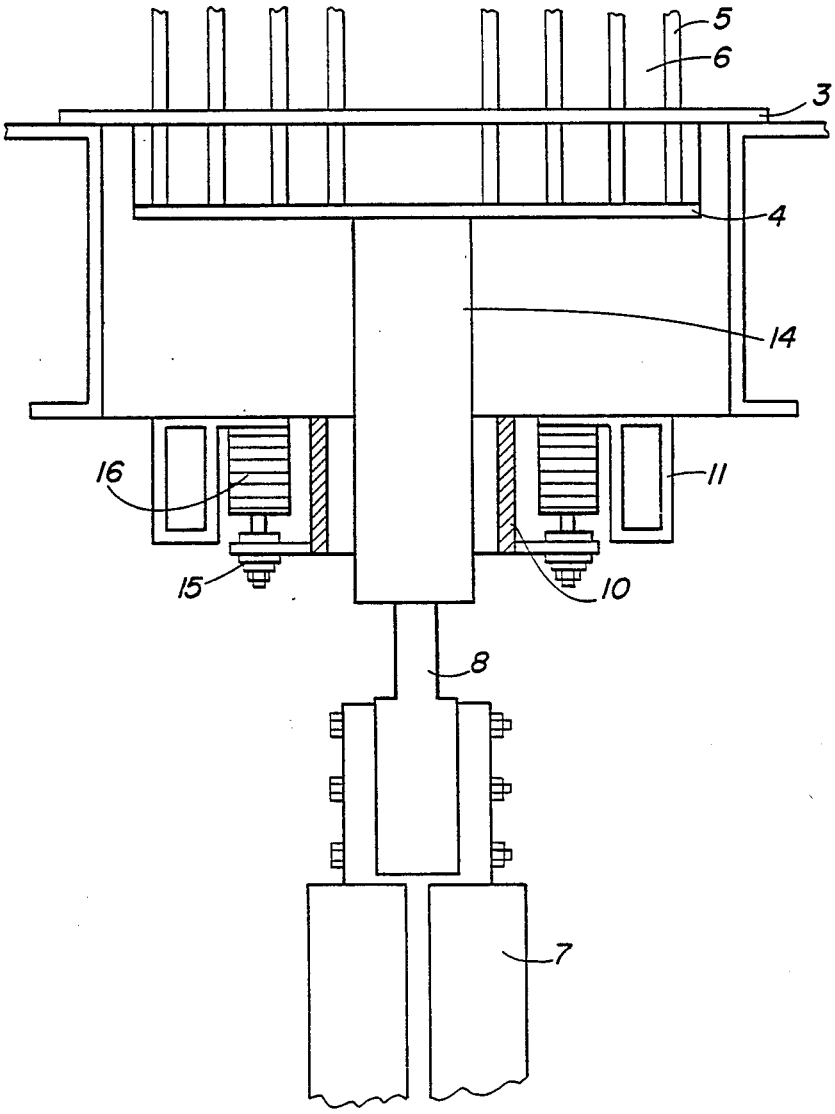
FIG. 3, is a view similar to FIG. 1 of the invention in a plane 90° from that of FIG. 2.

FIG. 3 shows the apparatus in a sectional view rotated by 90°. It can be seen that the tensioning frame 10 is fastened to the insulators 16 through a sliding connection 15. By means of this sliding connection, the tensioning frame 10 can automatically align itself toward the counter-contact 14 as the straps 8 are being applied. This freedom from undue force of the straps 8 achieved by the sliding connection and the angular mobility of the articulated bearings makes possible for the straps correct application on the counter-contact 14 and a uniform pressure distribution over the entire contact surface.

The insulators 16 are applied on supports 11. The supports 11 are attached to the furnace vessel 1. Through this arrangement it is brought about that current flows into the melt exclusively via the straps and the bottom electrode.

While specific embodiments of the invention have been shown and described in detail to illustrate the application of the principals of the invention, it will be understood that the invention may be embodied otherwise without departing from such principles.

What is claimed is:

1. An electrical metallurgical furnace comprising: a vessel; a bottom electrode positioned in the bottom of said vessel; at least one counter contact connected to said bottom electrode; a support anchored to said vessel; a tension frame; insulation mounting means connected to said support for insulative mounting of said tension frame relative to said support; at least one current cable positioned on a side of said counter contact; pivot means connected to said tension frame for pivotally supporting said at least one current cable with respect to said tension frame; and, biasing means for urging said pivotally supported at least one current cable into contact with said counter contact.

2. An electrical metallurgical furnace according to claim 1, wherein: said current cable includes a bearing portion and said pivot means includes a rod insertable into said bearing portion.

3. An electrical metallurgical furnace according to claim 2, wherein: said insulation mounting means includes a sliding connection member for fastening said tension frame to insulators associated with said insulation mounting means.

4. A metallurgical vessel according to claim 1 in which said means for pivotally supporting said cable include a carrying bolt having a recess forming a pivotal socket for each carrying bolt.

5. In an electrical metallurgical furnace according to claim 1, wherein said at least one current cable has a socket, and a bolt member mounted in said tensioning frame with a ball portion at its end engaged in the socket of said cable.

6. In an electrical metallurgical furnace according to claim 1 wherein said biasing means includes spring means acting on said bolt member 5 biasing said bolt member in a direction toward said counter-contact.

7. An electrical metallurgical furnace comprising:

a vessel; a bottom electrode positioned in the bottom of said vessel; at least one counter contact connected to said bottom electrode; a support anchored to said vessel; a tension frame; insulating mounting means connected to said support for insulative mounting of said tension frame relative to said support, said insulation mounting means including at least one insulator and a sliding connection member for fastening the tension frame to the insulators; at least one current cable on each side of said counter contact, said current cable having a planar surface and a opposite bearing portion; pivot means for pivotally supporting said at least one current cable, said pivot means including a carrying bolt connected to said tension frame, said carrying bolt being insertable into said bearing portion to allow pivotal movement of said at least one current cable about said carrying bolt; biasing means for urging said carrying bolt into said bearing portion and for urging said planar surface of said at least one current cable into engagement with said counter contact.

* * * * *